US010611531B2

(12) United States Patent
Hoefte et al.

(10) Patent No.: US 10,611,531 B2
(45) Date of Patent: Apr. 7, 2020

(54) LIQUID DISPENSER FOR AN INVERTED CONTAINER

(71) Applicant: The Procter & Gamble Company, Cincinnati, OH (US)

(72) Inventors: Paulus Antonius Augustinus Hoefte, Astene (BE); Jimmy Schoubben, Gentbrugge (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/205,428

(22) Filed: Nov. 30, 2018

(65) Prior Publication Data

US 2019/0161253 A1 May 30, 2019

(30) Foreign Application Priority Data

Nov. 30, 2017 (EP) ..... 17204557

(51) Int. Cl.
*B65D 47/20* (2006.01)
*B65D 1/32* (2006.01)
*B65D 51/24* (2006.01)

(52) U.S. Cl.
CPC ..... *B65D 47/2075* (2013.01); *B65D 1/32* (2013.01); *B65D 47/2031* (2013.01); *B65D 51/249* (2013.01); *B65D 47/2037* (2013.01)

(58) Field of Classification Search
CPC .. B65D 47/2031; B65D 47/2075; B65D 1/32; B65D 51/249; B65D 47/2037
See application file for complete search history.

(56) References Cited

U.S. PATENT DOCUMENTS 4,749,108 A 6/1988 Dornsbusch
5,626,262 A * 5/1997 Fitten ..... B65D 47/2031 222/184
5,655,687 A * 8/1997 Fitten ..... B65D 1/0276 222/185.1

(Continued)

FOREIGN PATENT DOCUMENTS

CN 2784322 Y 5/2006
JP 2007176594 A * 7/2007

(Continued)

OTHER PUBLICATIONS

Case CM4886 Search Report; PCT/US2018/051905; 11 Pages; Dated Jan. 1, 2019.

*Primary Examiner* — Frederick C Nicolas
(74) *Attorney, Agent, or Firm* — Melissa G. Krasovec

(57) ABSTRACT

The invention relates to a liquid dispenser for dispensing liquid from an inverted container. The dispenser includes a body adapted for releasably engaging to the inventor container, a valve localized in the body and defining a dispensing orifice that reacts to pressure differences for dispensing liquid to the exterior atmosphere, and an impact resistance system. The impact resistance system is located upstream of the valve and includes a housing that includes a cavity adapted to be occupied by a compressible substance. The compressible substance allows pressure equilibration between the valve interior side and the valve exterior side allowing the dispensing orifice to be reactively closeable, especially to absorb a hydraulic hammer pressure from an impact force.

20 Claims, 15 Drawing Sheets

(56) References Cited

U.S. PATENT DOCUMENTS

| | | | | | |
|---|---|---|---|---|---|
| 5,667,107 | A * | 9/1997 | Lindsey | B65D 23/003 | 222/173 |
| 5,868,288 | A * | 2/1999 | Redmond, Sr. | B65D 1/023 | 156/DIG. 27 |
| 6,705,492 | B2 * | 3/2004 | Lowry | A47K 5/122 | 222/184 |
| 8,783,519 | B2 * | 7/2014 | Fontaine | A45D 34/04 | 222/162 |
| 2019/0218484 | A1 * | 7/2019 | Brouwers | C11D 3/3723 | |
| 2019/0218485 | A1 * | 7/2019 | Brouwers | B65D 47/2018 | |

FOREIGN PATENT DOCUMENTS

| | | | |
|---|---|---|---|
| JP | 2007176594 | A | 7/2007 |
| WO | WO0068038 | A1 | 11/2000 |
| WO | WO2004002843 | A1 | 1/2004 |
| WO | WO2008118304 | A1 | 10/2008 |
| WO | WO2014130079 | A1 | 8/2014 |

* cited by examiner

LIQUID DISPENSER FOR AN INVERTED CONTAINER

FIELD OF THE INVENTION

The present invention relates to a liquid dispenser for dispensing liquid from an inverted container. The dispenser comprises a body, a valve and an impact resistance system especially adapted for absorbing transient liquid pressure increases (e.g., hydraulic hammer pressure) to substantially reduce/prevent undesirable opening of the valve and leakage of the liquid.

BACKGROUND OF THE INVENTION

Containers comprising a spout for dispensing a liquid are well known in the art, especially in the field of dishwashing cleaning products. These bottles have an opening located at the top and are typically referred to as "top-up bottles". In order to dispense the liquid, a consumer typically needs to open a cap to expose the spout, then invert and squeeze the bottle to dispense the liquid. Several problems exist with these top-up bottles. Firstly, the liquid flows out upon inversion of the bottle, even when the bottle is not squeezed making it difficult to control the amount of liquid to be dispensed from the bottle. This may also cause spillage of the liquid when the bottle is turned right side up after use. Secondly, these bottles appear messy as they tend to leave liquid around the rim of the spout. The liquid also tends to dry and forms a crust. If the crust is allowed to build up, then it eventually blocks the spout. Thirdly, the poor ergonomic design of these bottles causes consumer inconvenience. For example, constant twisting of the wrist to dose liquid from the top-up bottles can be uncomfortable or difficult on the consumers, especially with larger sized bottles and/or for the elderly consumers. Lastly, the presence of a closing cap or seal, which is needed to prevent solvent/other volatiles (e.g., perfumes) from evaporating, requires additional manipulations from the consumers making the bottles not user friendly. All these problems contribute to consumer dissatisfaction with these top-up bottles.

As a result, "inverted containers" have become popular with consumers. Inverted containers have an opening at the "bottom" for dispensing the liquid and are used in an upside-down position. The inverted containers typically rest on their bottom when placed on a horizontal surface. The inverted containers comprise a generally flexible bottle with a capped spout. An improvement to such a system may include a resilient valve in the discharge spout (see for example PCT WO2004/02843 (Method Products)). The aim of the valve is to help control the volume of liquid dispensed and minimize leakage with the inverted container so that liquid does not leak out unless force is applied to the containers.

A particular challenge with these types of inverted containers is the prevention of leakage of the liquid contained therein during steady state (i.e., storage) and/or upon impact, especially upon impact. For example, leakage may occur during storage when the inverted container is subjected to a temperature change, specifically increase (e.g., inverted container placed beside sunny window or near stove top, etc.), that can lead to internal pressure increases and leakage. Specifically, by "impact" it is meant that when the inverted container is handled, transported, dropped or knocked over. As a result of the impact, transient liquid pressure increases, also referred to as hydraulic hammer pressure, inside the container and can momentarily force open the valve causing liquid to leak out, which will result in consumer dissatisfaction with the product. Previous attempts to overcome the leakage problem have involved including a closing cap (see for example CN2784322U (Liu Zhonghai) & WO2014/130079 (Dow Global Technologies)). However, inclusion of a closing cap means additional steps of having to open the closing cap for dosing and reclose the closing cap after the dosing process, which is undesirable to consumers. Furthermore, the cap does not avoid liquid messiness and dried up crust of liquid around the spout/cap. Other attempts have incorporated baffles on top of the resilient valve (see for example JP2007/176594 (Lion), & WO2000/68038 (Aptar Group)), which have not completely resolved the leakage issue particularly as it pertains to inverted containers, more particularly upon impact.

Thus, the need remains for an improved liquid dispenser for an inverted container which substantially reduces or prevents the tendency of the valve to open when the inverted container is impacted, particularly dropped or knocked over. The need also exists for an improved liquid dispenser which reduces or prevents steady state leakage of the liquid. The need also exists for an improved liquid dispenser that accommodates the ease and/or accurate dispensing of the liquid. It is desirous that the improved liquid dispenser would greatly reduce or eliminate leakage so that the inverted container no longer requires a closing cap or seal. It is also desirous that the improved liquid dispenser has improve dispensing of the liquid with less residues, especially for sticky or high viscosity liquids. Further, it is desirous that the improved liquid dispenser accommodates inverted containers that have a variety of shapes and that are constructed from a variety of materials. The Applicant discovered that some or all of the above-mentioned needs can be at least partially fulfilled through the improved liquid dispenser as described herein below.

SUMMARY OF THE INVENTION

In one aspect, the present invention addresses these needs by providing a liquid dispenser for releasably affixing to an inverted container containing dispensable liquid. The liquid dispenser accommodates the dispensing of dispensable liquid from the inverted container in an upside down or inverted position. The liquid dispenser comprises a body, a valve and an impact resistance system. The impact resistance system functions to substantially reduce or prevent the tendency of the valve to open under transient liquid pressure increases such as hydraulic hammer pressure that can occur when the inverted container is impacted (i.e., dropped or knocked over). This will substantially reduce or prevent the likelihood that liquid will inadvertently leak from the liquid dispenser, particularly during impact.

According to this aspect of the present invention, the body of the dispenser comprises a connecting sleeve. The connecting sleeve is adaptable for engaging to an exterior surface proximate an opening of the inverted container and is spaced radially inwardly to define an internal discharge conduit for establishing fluid communication with the liquid contained in the inverted container.

The valve is localized in the body and extends across the internal discharge conduit. The valve has an interior side for being contacted by the liquid contained inside the inverted container and an exterior side for being exposed to the exterior atmosphere. The valve defines a dispensing orifice that is reactively openable when the pressure on the valve interior side exceeds the pressure on the valve exterior side.

The impact resistance system is located upstream of the valve. The system comprises a housing, the housing having a cavity therein and extending longitudinally from the body and radially inwardly from the sleeve. The housing comprises at least one inlet opening that provides a flow path for the liquid from the inverted container into the housing and at least one outlet opening that provides a path of egress for the liquid from the housing to the exterior atmosphere when the dispensing orifice is opened. The cavity is adapted to be partially occupied by a compressible substance. Preferably the compressible substance allows pressure equilibration between the valve interior side and the valve exterior side allowing the dispensing orifice to be/remain reactively closeable.

In another aspect, the present invention relates to a method of using a liquid dispenser according to the claims for dispensing liquid from an inverted container.

In yet another aspect, the present invention relates to use of a liquid dispenser according to the claims for reducing or preventing leakage of liquid from an inverted container. Especially, the reduction or prevention of liquid leakage when the inverted container is subjected to a hydraulic hammer pressure.

In yet another aspect, the present invention relates to an inverted container comprising a liquid dispenser as claimed. Preferably, the inverted container does not comprise a closing cap or seal.

One aim of the present invention is to provide a liquid dispenser as described herein which can substantially reduce or prevent the tendency of the valve to open when the inverted container is impacted, particularly dropped or knocked over, so that the liquid does not leak out. Such an improved liquid dispenser would accommodate more rugged handling or abuse of the inverted container.

Another aim of the present invention is to provide a liquid dispenser as described herein which prevents steady state leakage of the liquid. It is advantageous that the valve remains closed during storage of the inverted container so that the liquid does not leak out unless force is intentionally applied to the inverted container to dispense the liquid. This avoids messy dried liquid forming near the dispensing orifice, which can potentially block the liquid from being dispensed, or messiness in the storage area leading to eventual surface damage when stored on delicate surfaces.

A further aim of the present invention is to provide a liquid dispenser as described herein that allows for ease and accurate dosing without needing to turn the containers over. This is believed to contribute to faster and improved ergonomic dosing experience (i.e., more comfortable, less stress on the wrist, less strength needed, etc.). For example, less steps are required then with conventional top-up bottles or upside-down containers that may include a closing cap or seal, and no awkward twisting motion of the hands is needed to invert the bottle upside-down to dispense the liquid.

Yet a further aim of the present invention is to provide a liquid dispenser as described herein that would allow access to every last drop of the liquid inside the inverted containers. Thus, it is an advantage of the invention to minimize waste.

The present invention also has the advantage of allowing for a larger formulation window of operable viscosity since formulators can now include liquids having a larger viscosity range, particularly liquids having lower viscosities which tend to be more sensitive to leakage.

Another advantage of the present invention is that it allows for use with larger sized containers (e.g., greater than 450 mL). It is expected that the improved liquid dispenser enables higher weight tolerances on the resilient valve thereby substantially reducing/preventing liquid leakage when used with larger inverted containers.

These and other features, aspects and advantages of the present invention will become evident to those skilled in the art from the detailed description which follows.

BRIEF DESCRIPTION OF THE DRAWINGS

While the specification concludes with claims particularly pointing out and distinctly claiming the invention, it is believed that the invention will be better understood from the following description of the accompanying figures wherein like numerals are employed to designate like parts throughout the same:

DETAILED DESCRIPTION OF THE INVENTION

Figure 1:
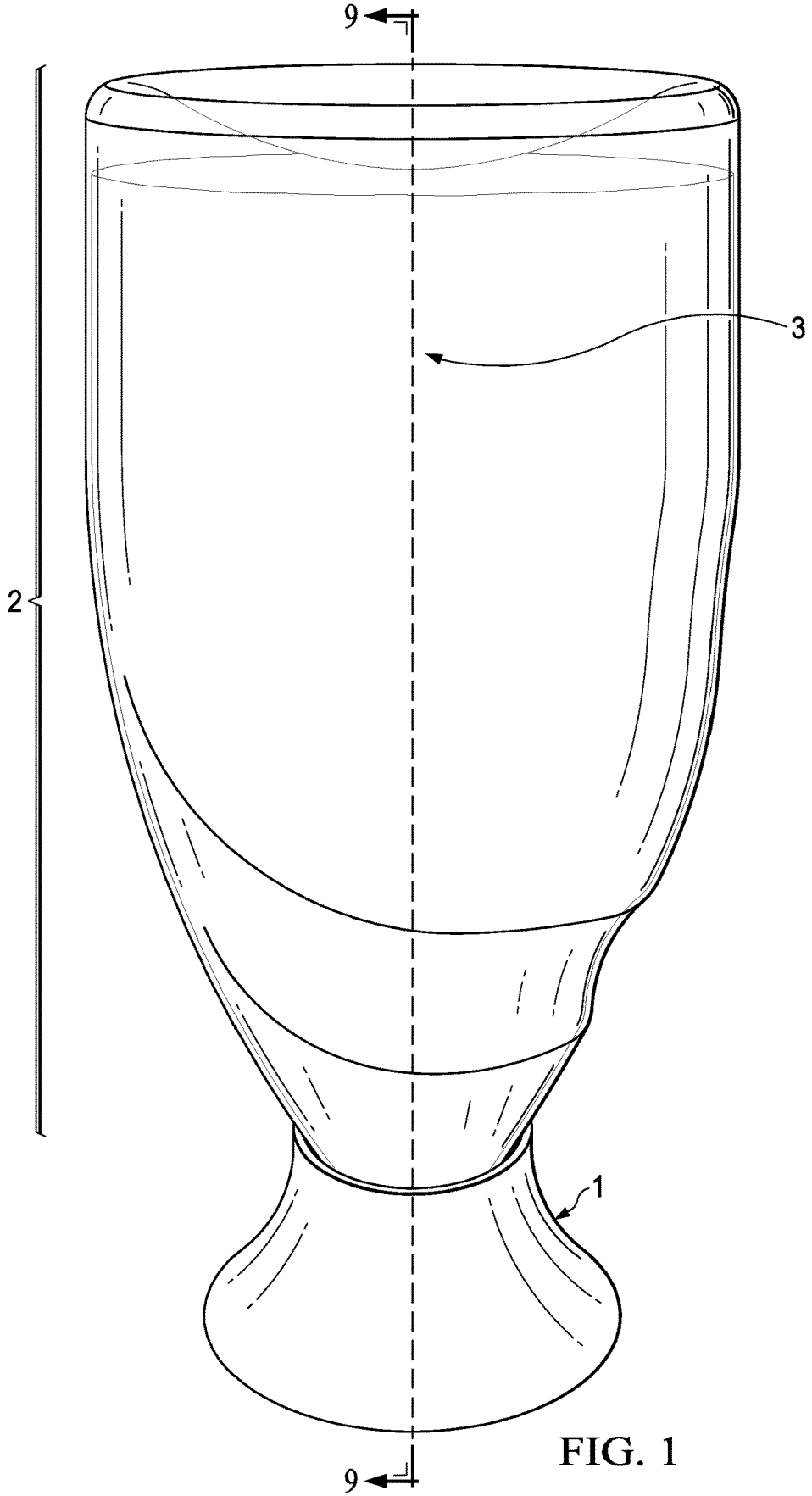
FIG. 1 shows a perspective view of a liquid dispenser (1) according to one aspect of the present invention connected to an inverted container (2).

It is to be understood that the scope of the claims is not limited to the specific devices, apparatuses, methods, conditions or parameters described and/or shown herein, and that the terminology used herein is for the purpose of describing particular aspects of the invention by way of examples only and is not intended to be limiting of the claimed invention.

As used herein, articles such as "a" and "an" when used in a claim, are understood to mean one or more of what is claimed or described.

As used herein, any of the terms "comprising", "having", "containing", and "including" means that other steps, ingredients, elements, etc. which do not adversely affect the result can be added. Each of these terms encompasses the terms "consisting of" and "consisting essentially of". Unless otherwise specifically stated, the elements and/or equipment herein are believed to be widely available from multiple suppliers and sources around the world.

As used herein, the term "compressible" means the ability of a substance to reduce volume under influence of increased pressure, in which the volume reduction is at least 1%, preferably at least 5%, most preferably at least 10%.

As used herein, the term "consumers" is meant to include the customers who purchase the product as well as the person who uses the product.

As used herein, the term "hydraulic hammer pressure" means a transient pressure increase caused when the liquid inside the inverted container is forced to stop or change direction suddenly (i.e., momentum change) typically as a result of impact to the inverted container. Hydraulic hammer pressure can also be referred to as "impact force". If the hydraulic hammer pressure is not somehow absorbed by the liquid dispenser, then the force might (momentarily) open the valve and cause leakage of the liquid.

The terms "include", "includes" and "including" are meant to be non-limiting.

As used herein, the term "liquid" means any liquid including highly viscous materials (e.g., lotions and creams), suspensions, mixtures, etc. For example, a "liquid" may constitute a personal care product, a food product (e.g., ketchup, mayonnaise, mustard, honey, etc.), an industrial or household cleaning product (e.g., laundry detergent, dish washing cleaning detergent, etc.), or other compositions of matter (e.g., compositions for use in activities involving manufacturing, commercial or household maintenance, personal/beauty care, baby care, medical treatment, etc.). Key targeted liquid is a hand dishwashing liquid detergent. The liquid product preferably the liquid detergent product, more preferably the liquid hand dishwashing product may have any density, however the liquid preferably has a density between 0.5 g/mL and 2 g/mL, more preferably between 0.8 g/mL and 1.5 g/mL, most preferably between 1 g/mL and 1.2 g/mL.

As used herein, the term "steady state" means the constant pressure properties of the liquid inside the container when it is at rest.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "1.2 cm" is intended to mean "about 1.2 cm".

It is understood that the test methods that are disclosed in the Test Methods Section of the present application must be used to determine the respective values of the parameters of Applicants' inventions as described and claimed herein.

In all embodiments of the present invention, all percentages are by weight of the total composition, as evident by the context, unless specifically stated otherwise. All ratios are weight ratios, unless specifically stated otherwise, and all measurements are made at 25° C., unless otherwise designated.

Liquid Dispenser

For ease of description, the liquid dispenser (1) of this invention is described with terms such as upper/top, lower/bottom, horizontal, etc. in reference to the position shown in FIG. 1. With continued reference to FIGS. 1 and 9, it will be understood however, that the liquid dispenser (1) of the invention is used with an inverted container (2) wherein the liquid is dispensed from the bottom of the inverted container (2). The inverted container (2), insofar as it has been described, may be of any suitable shape or design so long as it can rest in an upside-down or inverted position, the details of which form no part of the present invention directed to the liquid dispenser (1). The inverted container (2) can be made of any flexible plastic materials, such as thermoplastic polymers. The flexible materials are compressible enough to deform the inverted container (2) and enable dosing of the liquid yet sufficiently flexible to enable relatively fast shape recovery from the deformation post dosing. Preferably, the flexible plastic materials are polycarbonate, polyethylene (PE), polypropylene (PP), polyvinylchloride (PVC), polyethylene terephthalate (PET) or the like, or blends or multilayer structures thereof. The flexible plastic material may also container specific moisture or oxygen barrier layers like ethylene vinyl alcohol (EVOH) or the like. The flexible plastic materials may also partially comprise post-consumer recycled materials from bottles, other containers or the like. The inverted container (2) includes an opening (5) (not shown) so as to enable liquid to pass from the inverted container (2) into the liquid dispenser (1). With reference to FIG. 1, the opening (5) (not shown) is situated at the bottom of the inverted container (2). In other words, the inverted container (2) is dosed from the bottom.

Figure 2:
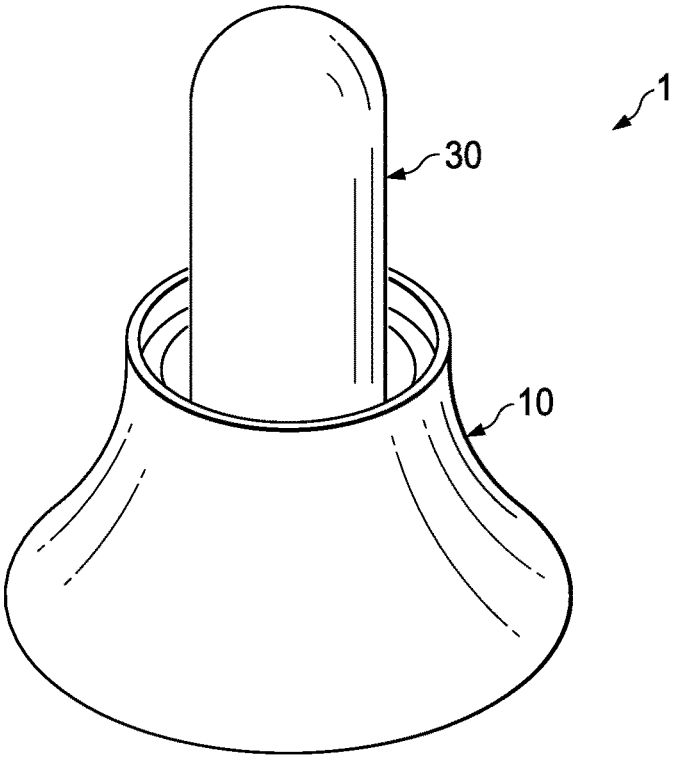
FIG. 2 shows a perspective view of a liquid dispenser (1) according to one aspect of the present invention.

The liquid dispenser (1), or at least certain components of the dispenser (1), can be made from any materials which can be molded or shaped, while still being durable enough to hold up to being transported and regular wear and tear with constant exposure to a liquid. The dispenser (1) components may be separately molded and may be molded from different materials. The materials for the different components, unless specifically specified, may have the same or different colors and textures for aesthetic purposes. Preferably, the components are molded from a hard plastic, more preferably a thermoplastic material, such as for example, polypropylene (PP), polycarbonate, polyethylene (PE), polyvinylchloride (PVC) or the like. As shown in FIG. 2, the liquid dispenser (1) comprises three basic components, a body (10), a valve (20) (not shown) and an impact resistance system (30). Preferably the liquid dispenser (1) is free of a closing cap or seal. Typically, the seal is included for transport and is removed and discarded after the first use of the liquid dispenser (1).

Body

Figure 3:
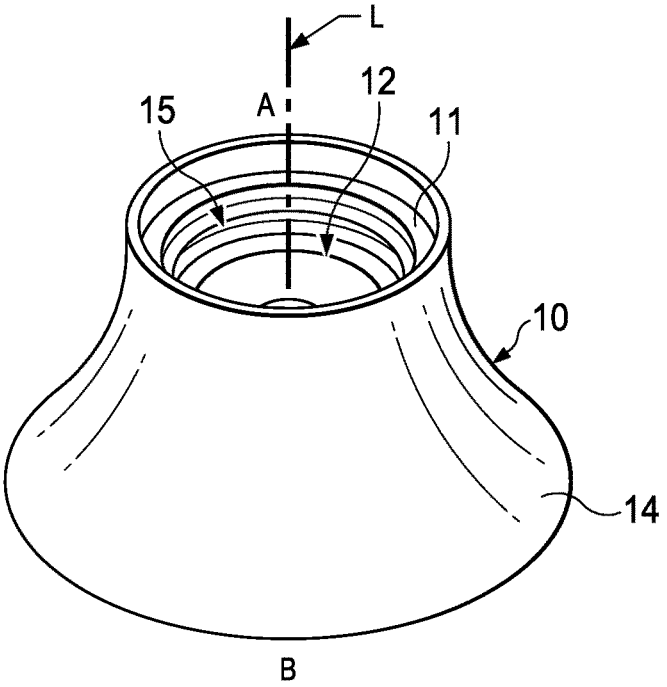
FIG. 3 shows a perspective view of the body (10) of the liquid dispenser (1) according to the present invention.

As shown in FIG. 3, the liquid dispenser (1) comprises a body (10). The body (10) includes at a top end (A) a connecting sleeve (11) adapted for releasably engaging to an exterior surface proximate an opening (5) of the inverted container (2). Preferably this arrangement provides leak tight contact between the liquid dispenser (1) and the inverted container (2) making the liquid dispenser (1) sealingly tight against leakage. Alternatively, the connecting sleeve (10) may be adapted for releasably engaging to an interior surface proximate an opening (5) of the inverted container (2). In other words, the inverted container (2) is attached to the connecting sleeve (11) located on the horizontal exterior of the body (10) of the liquid dispenser. However, this alternative arrangement is less preferred since there is a higher leakage risk of liquid passing through the contacts between the dispenser (1) and the inverted container (2).

The body (10) can be releasably engaged to the opening (5) of the inverted container (2) by suitable means of attachment commonly known to those skilled in the art, including for non-limiting example co-operative threads, crimping, clipping means, clasp-means, snap-fit means, groove arrangements, bayonet fittings, or permanently welded. Preferably, the male thread on the exterior surface of the opening (5) of the inverted container (2) is screwed on the female thread which has been molded onto the connecting sleeve (11) (as illustrated in FIG. 3).

The body (10) includes a central portion (15) axially disposed along the longitudinal axis (L). The connecting sleeve (11) is spaced radially inwardly towards the central portion (15) and defines an internal discharge conduit (12). The discharge conduit (12) functions as a flow passage for establishing fluid communication with the liquid contained in the inverted container (2) to the exterior atmosphere. It will be understood that in use, the connecting sleeve (11) forms a fluid seal between the liquid dispenser (1) and the inverted container (2) so that the liquid can enter the liquid dispenser (1) without leaking.

Preferably, the body (10) comprises at a bottom end (B) an exterior portion (14) adapted to allow the inverted container (2) to stably rest on its bottom on a flat surface (as shown in FIG. 1). The exterior portion (14) may be integrally formed with the body (10). For example, the exterior portion (14) comprises an annular flange structure (e.g., skirt) that extends axially downward towards the bottom (B) and radially outward as shown in FIG. 3. While FIG. 3 depicts the exterior portion (14) of the body (10) as having a frustoconical shape, it is not necessarily limited to this shape. Other shapes such as cylindrical, pyramid shape, disk shape, multiple legs, etc. could be used so long as they allow for the inverted container (2) to remain stably rested on its bottom.

It should be understood that while the body (10) has been shown and described herein, there are many variations that may be desirable depending on the particular requirements. For example, while the connecting sleeve (11) and the exterior portion (14) have been shown as having uniform material thickness, in some applications it may be desirable for the material thickness to vary. By way of further example, while a number of surfaces have been described herein as having a specific shape (e.g., frustoconical, planar, etc.) other specific shapes may be desirable for those surfaces depending upon the particular application.

Valve

The liquid dispenser (1) further comprises a valve (20) localized in the body (10) extending across the internal discharge conduit (12). As show by FIG. 4, the valve (20) has an interior side (21) for being contacted by the liquid contained inside the inverted container (2) and an exterior side (22) (as shown in FIG. 5) for being exposed to the exterior atmosphere. The valve (20) defines a dispensing orifice (23) that is reactively openable when the pressure on the valve interior side (21) exceeds the pressure on the valve exterior side (22).

The valve (20) is preferably a flexible, elastomeric, resilient, 2-way bi-directional, self-closing, slit-type valve mounted in the body (10). The valve (20) has slit or slits (25) which define the dispensing orifice (23). For example, the dispensing orifice (23) may be formed from one slit (25) or two or more intersecting slits (25), that may open to permit dispensing of liquid therethrough in response to an increased pressure inside the inverted container (2), such as for example, when the inverted container (2) is squeezed. The valve (20) is typically designed so as to reactively close the dispensing orifice (23) and stop the flow of liquid therethrough upon a reduction of the pressure differential across the valve (20). The amount of pressure needed to keep the valve (20) in the closed position will partially depend on the internal resistance force of the valve (20). The "internal resistance force" (i.e., cracking-pressure) refers to a predetermined resistance threshold to deformation/opening of the valve (20). In other words, the valve (20) will not tend to resist deformation/opening so that it remains closed under pressure of the steady state liquid bearing against the interior side (21) of the valve (20). The amount of pressure needed to deform/open the valve must overcome this internal resistance force. This internal resistance force must not be too low so as to cause liquid leakage or too high to make dispensing a dose of liquid difficult. Accordingly, the valve (20) preferably has an internal resistance force of the valve (20) that is at least 10 mbar, preferably at least 25 mbar, more preferably less than 250 mbar, even more preferably less than 150 mbar, most preferably less than 75 mbar. Preferably, the dispensing orifice (23) is designed to be in the open position when a pressure difference (Δ) of at least 10 mbar, preferably at least 25 mbar exists between the valve interior side (21) in relation to the valve on the exterior side (22). Preferably the force exerted on the valve interior side (21) that is required in order to open the dispensing orifice (23) is at least 10 mbar, preferably at least 25 mbar. Preferably the valve (20) has a surface area of between 0.1 $cm^2$ and 10 $cm^2$, more preferably between 0.3 $cm^2$ and 5 $cm^2$, most preferably between 0.5 $cm^2$ and 2 $cm^2$. Preferably the valve (20) has a height of between 1 mm and 10 mm, more preferably between 2 mm and 5 mm. Other dimensions could be used so long as they allow for the dispensing orifice (23) to remain in the fully closed position at rest.

Figure 4:
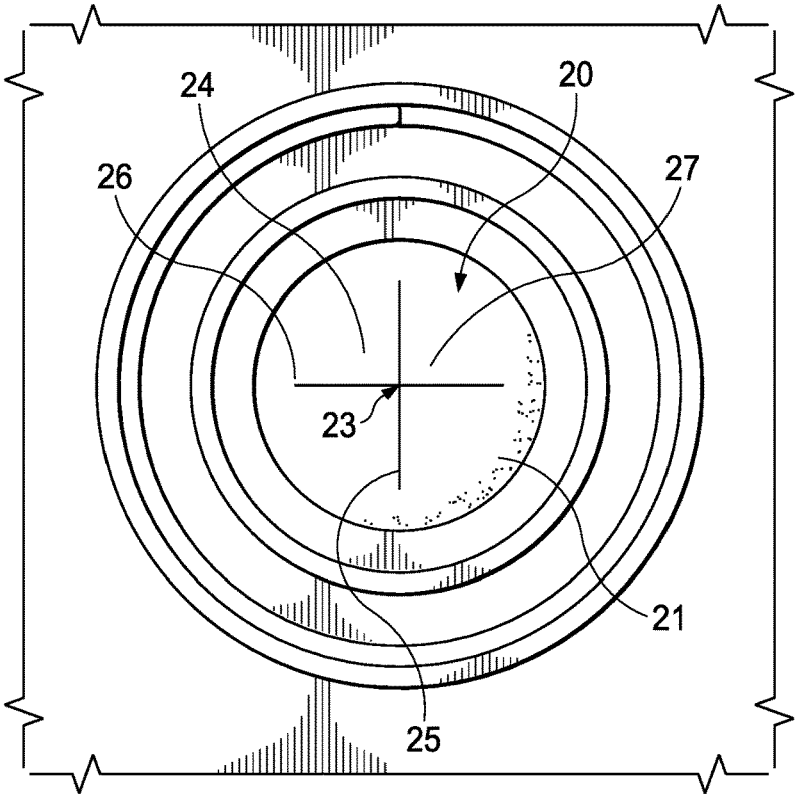
FIG. 4 shows a plan top view of the interior side (21) of the valve (20) of the liquid dispenser (1) according to the present invention.
Figure 5:
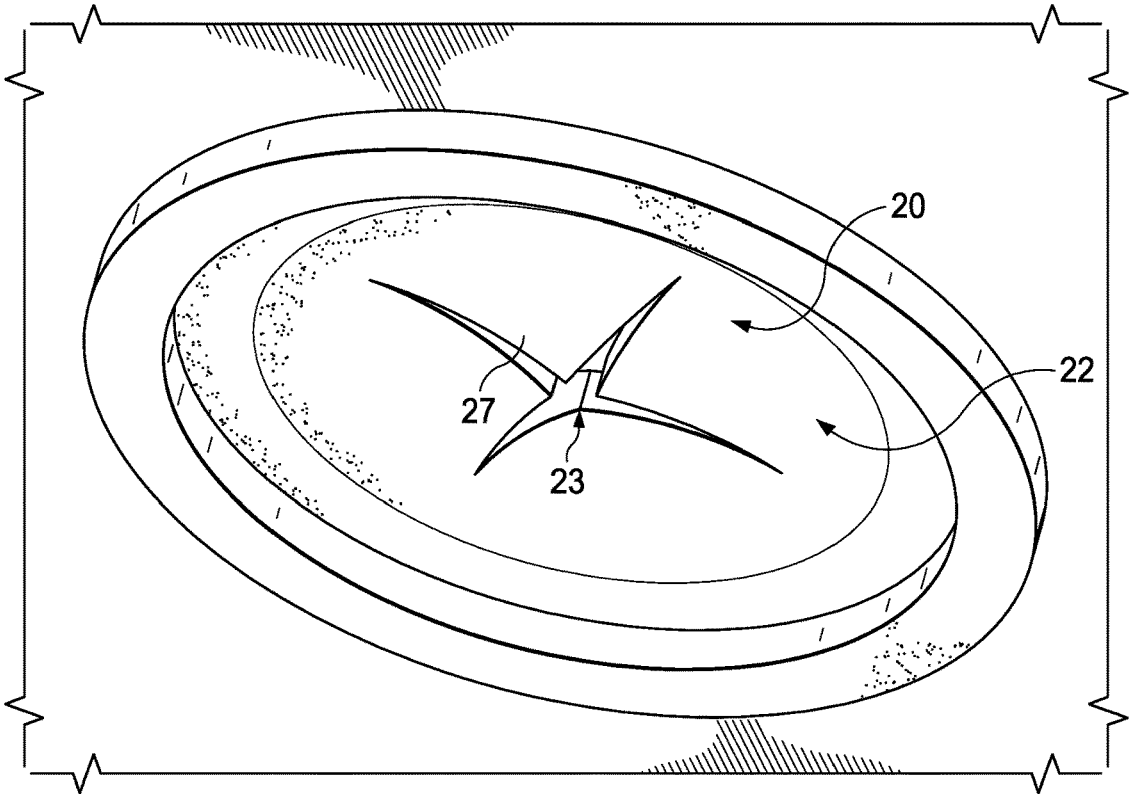
FIG. 5 is a perspective view of the exterior side (22) of the valve (20) of the liquid dispenser (1) according to the present invention in the open position.

As shown in FIG. 4, the valve (20) preferably includes a flexible central portion (24) having at least one, preferably at least two, preferably a plurality (i.e., three or more), of planar, self-sealing, slits (25) which extends radially outward towards distal ends (26). It should be understood that slit valve is intended to refer to any valve that has one or more slits in its final functioning form, including such valve wherein one or more of the slits, is/are only fully completed after the valve has been formed and/or installed in the liquid dispenser (1). Each slit (25) preferably terminates just before reaching the distal end (26) in the valve (20). Preferably, the slits (25) are straight (as shown in FIG. 4) or may have various different shapes, sized and/or configurations (not shown). Preferably, the intersecting slits (25) are equally spaced from each other and equal in length.

With continued reference to FIG. 5, the intersecting slits (25) define four, generally sector-shaped, equally sized flaps (27) in the valve (20). The flaps (27) may be characterized as the openable portions of the valve (20) that reacts to pressure differences to change configuration between a closed, rest position (as shown in FIG. 4) and an open position (as shown in FIG. 5). The valve (20) is designed to be flexible enough to accommodate in-venting of exterior atmosphere. For example, as the valve (20) closes, the closing flaps (27) or openable portions can continue moving inwardly pass the closed position to allow the valve flaps (27) to open inwardly when the pressure on the valve exterior side (22) exceeds the pressure on the valve interior side (21) by a predetermined magnitude. Such in-venting capability of the exterior atmosphere helps equalize the interior pressure inside the inverted container (2) with the pressure of the exterior atmosphere. It is understood that the valve (20) is designed so that the opening pressure to vent air back into the inverted container (2) is low enough to avoid paneling of the inverted container (2) during use. In other words, the resilience of the inverted container (2) to return to its initial shape after use (i.e., squeezing force) is higher than the venting opening pressure.

Preferably the valve (20) is not contacting the surface on which the inverted container (2) is standing when at rest, nor contacting the surface to be cleaned upon dosing. Heretofore the valve (20) is augmented into the body (10), preferably being positioned at least 1 mm from the resting surface, more preferably at least 5 mm, even more preferably at least 1 cm. By positioning the valve (20) above rather than in contact with the surface there is less risk of capillary seeping through the valve (20) leading to surface contamination and potentially surface damage upon storage of the inverted container (2).

The valve (20) is preferably molded as a unitary structure from materials which are flexible, pliable, elastic and resilient. Suitable materials include, such as for example, thermosetting polymers, including silicone rubber (available as D.C. 99-595-HC from Dow Corning Corp., USA; WACKER 3003-40 Silicone Rubber Material from Wacker Silicone Co.) preferably having a hardness ration of 40 Shore A, linear low-density polyethylene (LLDPE), low density polyethylene (LDPE), LLDPE/LDPE blends, acetate, acetal, ultra-high-molecular weight polyethylene (UHMW), polyester, urethane, ethylene-vinyl-acetate (EVA), polypropylene, high density polyethylene or thermoplastic elastomer (TPE). The valve (20) can also be formed from other materials such as thermoplastic propylene, ethylene and styrene, including their halogenated counterparts. Suitable valves are commercially available such as from the APTAR Company including the SimpliSqueeze® valve line up.

The valve (20) is normally in the closed position and can withstand the pressure of the liquid inside the inverted container (2) so that the liquid will not leak out unless the inverted container (2) is squeezed. Unfortunately, the design of the valve (20) limits their effectiveness in preventing liquid leakage from inside the inverted container (2) under all situations, particularly when the inverted container (2) has been impacted causing a substantial transient liquid pressure increase. Accordingly, the inventors have surprisingly discovered that by incorporating an impact resistance system (30) into the liquid dispenser (1), it can help to absorb the transient liquid pressure increase after the impact and substantially reduce or prevent liquid leakage from the liquid dispenser (1).

Impact Resistance System

Figure 6:
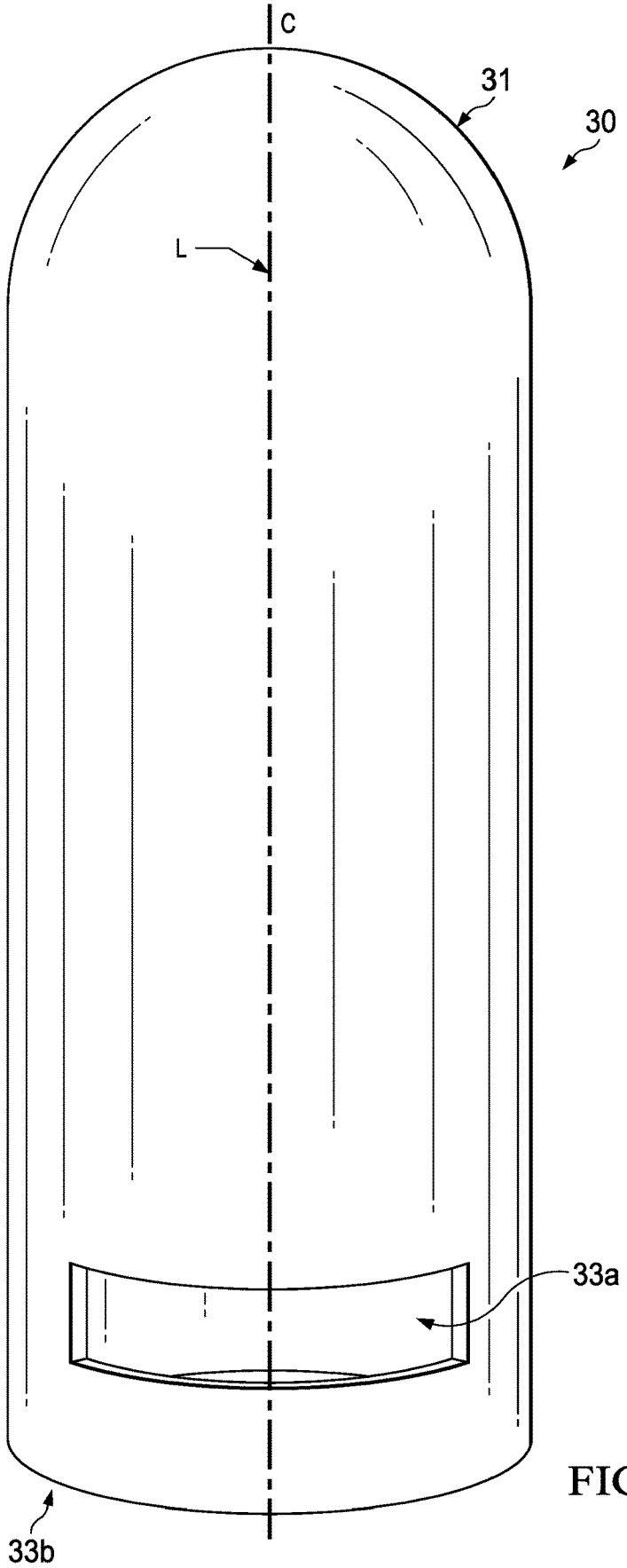
FIG. 6 shows a perspective view of the impact resistance system (30) of the liquid dispenser (1) according to the present invention.

According to the invention, the liquid dispenser (1) further comprises an impact resistance system (30) (as shown in FIG. 6) localized upstream of the valve (20). The system (30) comprises a housing (31) having a cavity (32) therein the housing (31). The housing (31) extends longitudinally from the body (10) radially inward from the sleeve (11). The housing (31) is a substantially rigid structure and may be molded from plastic material, preferably a thermoplastic material, more preferably polypropylene. As shown in FIG. 6, the housing (31) is preferably substantially cylindrical shaped with a dome towards the top end (C) having a length along the longitudinal axis (L) of from 10 mm to 200 mm, preferably from 15 mm to 150 mm, more preferably from 20 mm to 100 mm. The cylindrical shaped housing (31) preferably has a diameter of from 5 mm to 40 mm, preferably from 10 mm to 30 mm. However, it should be understood that the housing (31) may have any desired size and shape, such as for example, oval, pyramid, rectangular, etc. However, the size and shape of the housing (31) will, of necessity, be a function of the internal volume needed for the compressible substance. For example, when a higher volume of compressible substance is required, a wider diameter of the housing might be preferred. Preferably, the housing (31) has an inside volume of from 200 $mm^3$ to 250,000 $mm^3$, preferably from 1,500 $mm^3$ to 75,000 $mm^3$. Preferably the compressible substance has a volume of from 1,000 $mm^3$ up to 20,000 $mm^3$, preferably from 1,500 $mm^3$ up to 15,000 $mm^3$, most preferably from 2,000 $mm^3$ up to 10,000 $mm^3$.

Figure 9:
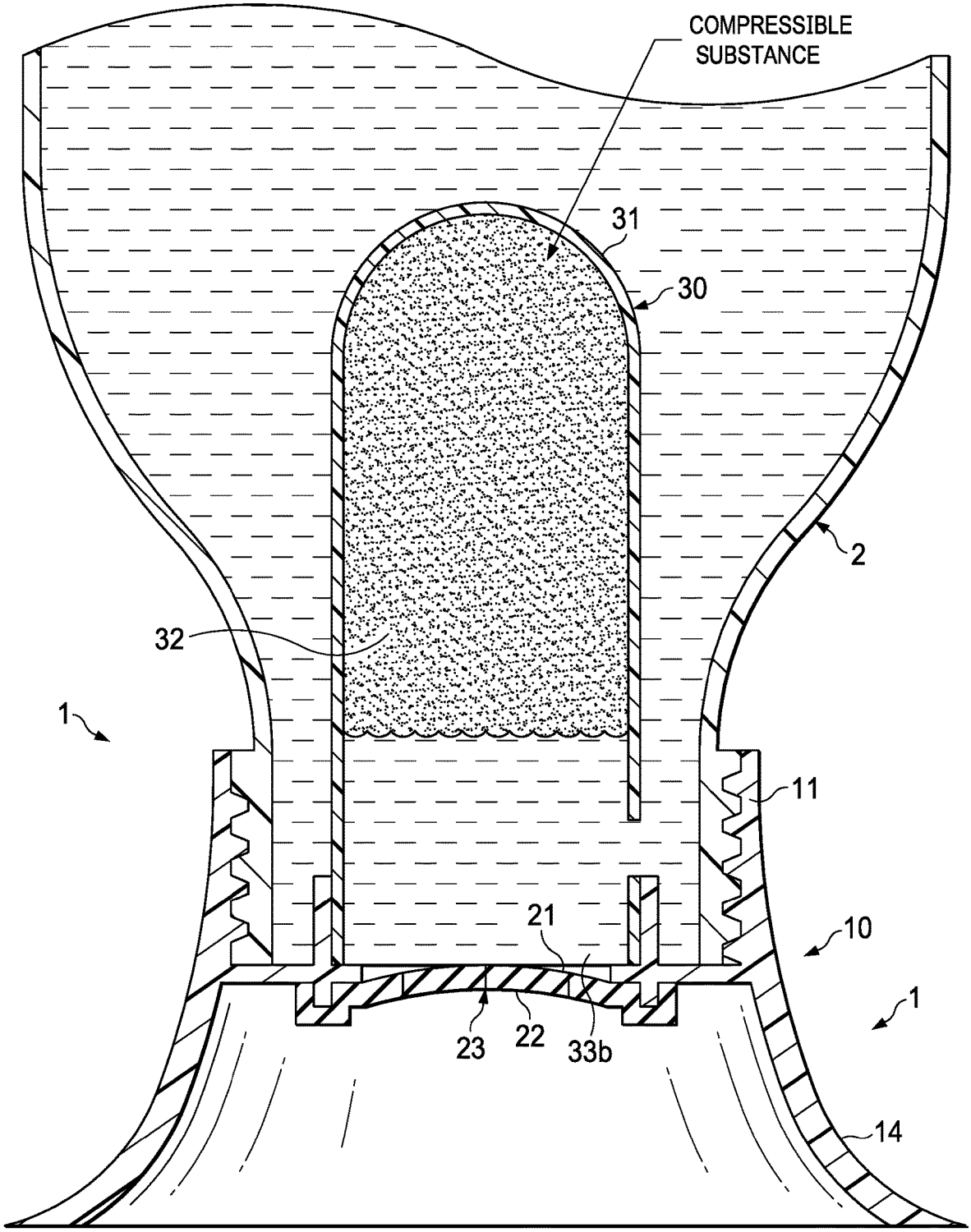
FIG. 9 shows a cross sectional view of the liquid dispenser (1) of FIG. 1 taken along section line 9-9.

Furthermore, the housing (31) comprises at least one inlet opening (33*a*) that provides a flow path for the liquid from the inverted container (2) into the housing (31). Preferably the inlet opening (33*a*) is an opening between the discharge conduit (12) and the valve (20). The phrase "at least one" inlet opening (33*a*) means one or more inlet openings (33*a*) located on the housing (31). For example, it may be desirable to have one larger inlet opening (33*a*) or multiple smaller inlet openings (33*a*). It would be expected that the viscosity and density of the liquid contained inside of the inverted container (2) factors into the design of the size, shape and number of the inlet openings (33*a*). The inlet opening (33*a*) functions as an opening for providing a liquid flow path to establishing fluid communication with the liquid contained inside the inverted container (2) and the housing (31). As shown in FIGS. 6 and 9, the inlet opening (33*a*) is preferably positioned near the bottom of the housing (31) and preferably is rectangular shaped having a length of between 1 mm and 25 mm, preferably between 5 mm and 20 mm, and a height of between 1 mm and 10 mm, preferably between 3 and 7 mm. Alternatively, other shape and sized inlet openings (33*a*) can also be operable so long as they can still provide sufficient flow of liquid from the inverted container (2) into the housing (31). For other non-limiting examples, the housing (31) can contain three small circular inlet openings (33*a*) disposed at equal distance near the bottom or one semi-circle surrounding half of the housing (31). Preferably, the inlet opening (33*a*) has a total surface area of 1 $mm^2$ to 250 $mm^2$, preferably 15 $mm^2$ to 150 $cm^2$. Also, it is preferable that the inlet opening (33*a*) is positioned towards the bottom of the housing (31).

The housing (31) further comprises at least one outlet opening (33*b*) that provides a path of egress for the liquid from the housing (31) to the exterior atmosphere when the dispensing orifice (23) is opened.

Figure 7A:
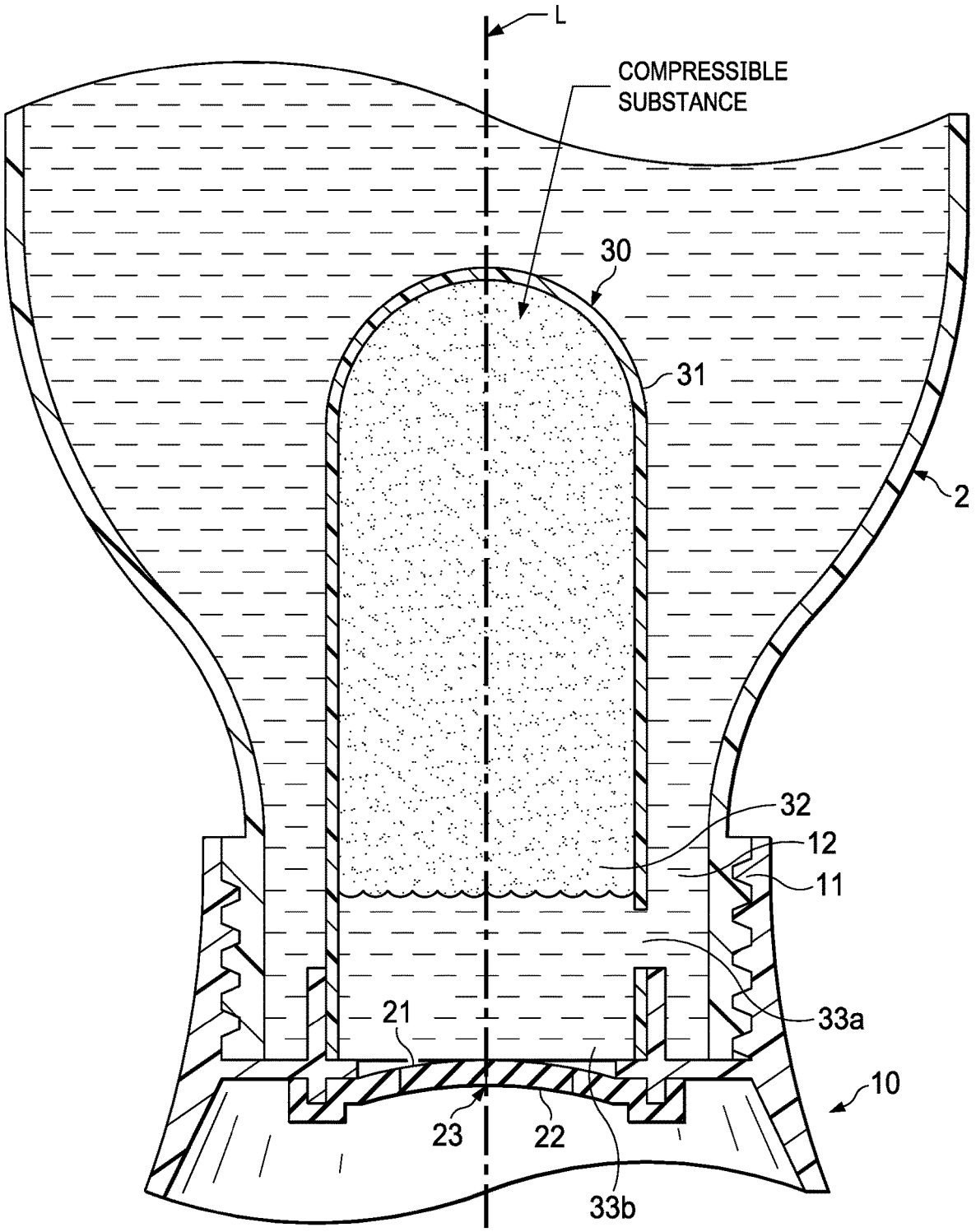
FIG. 7*a* shows a cross-sectional view of the impact resistance system (30) of the liquid dispenser (1) according to the present invention, prior to the "impact" and with the compressible substance uncompressed.

As shown in FIG. 7*a*, the housing (31) further comprises a cavity (32). The cavity (32) is a hollow open space inside the housing (31). The cavity (32) is adapted to be partially occupied by a compressible substance. Preferably the compressible substance allows pressure equilibration between the valve interior side (21) and the valve exterior side (22) allowing the dispensing orifice (23) to be/remain reactively closeable. In other words, the compressible substance is to remain uncompressed, prior to "impact" of the inverted container (2), at pressure sufficient to allow the valve (20) to remain closed and retain the liquid inside the inverted container (2). The cavity (32) is also partially occupied by the liquid prior to "impact".

Figure 7B:
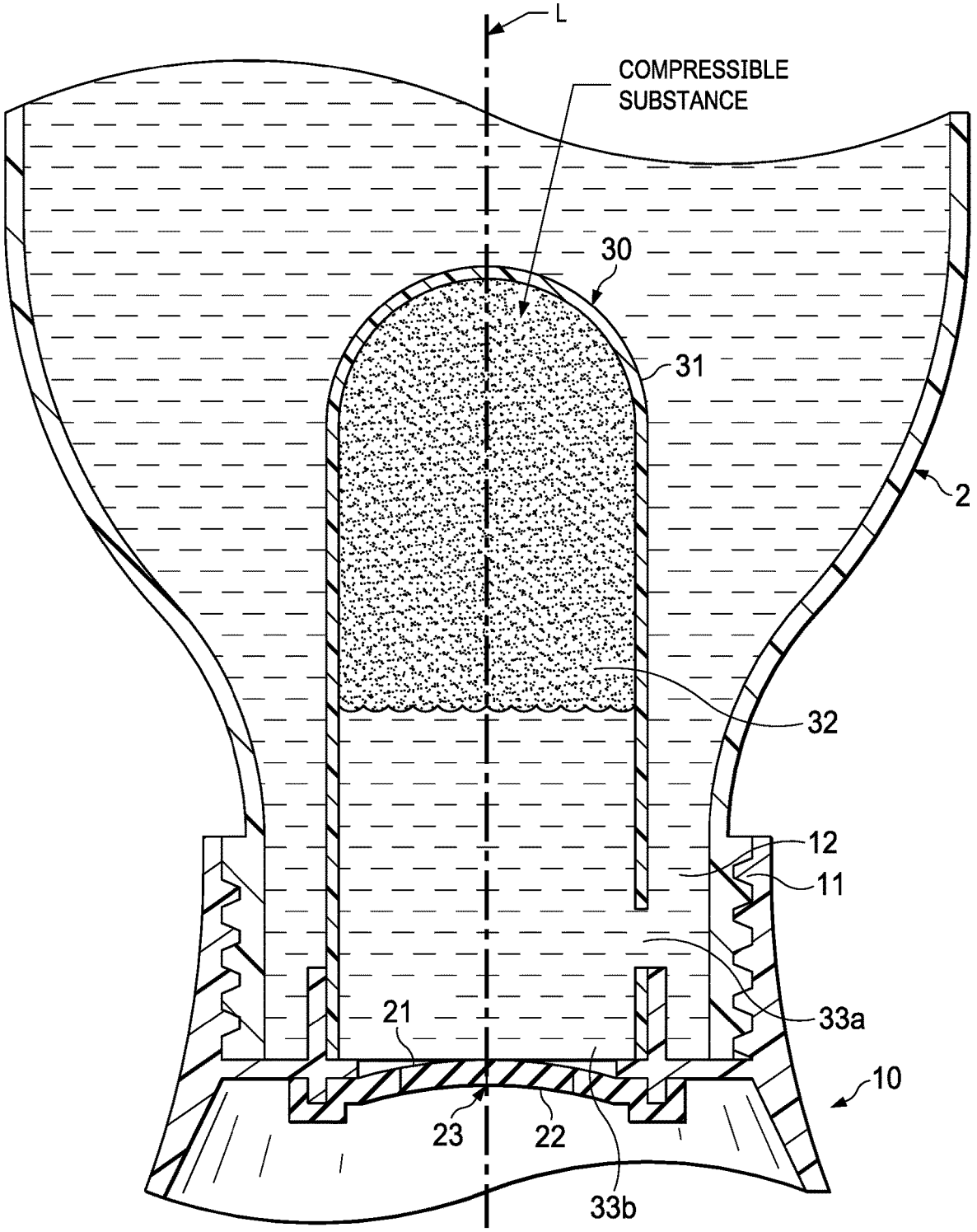
FIG. 7*b* shows a cross-sectional view of the impact resistance system (30) of the liquid dispenser (1) according to the present invention, during the "impact" and with the compressible substance compressed.
Figure 7C:
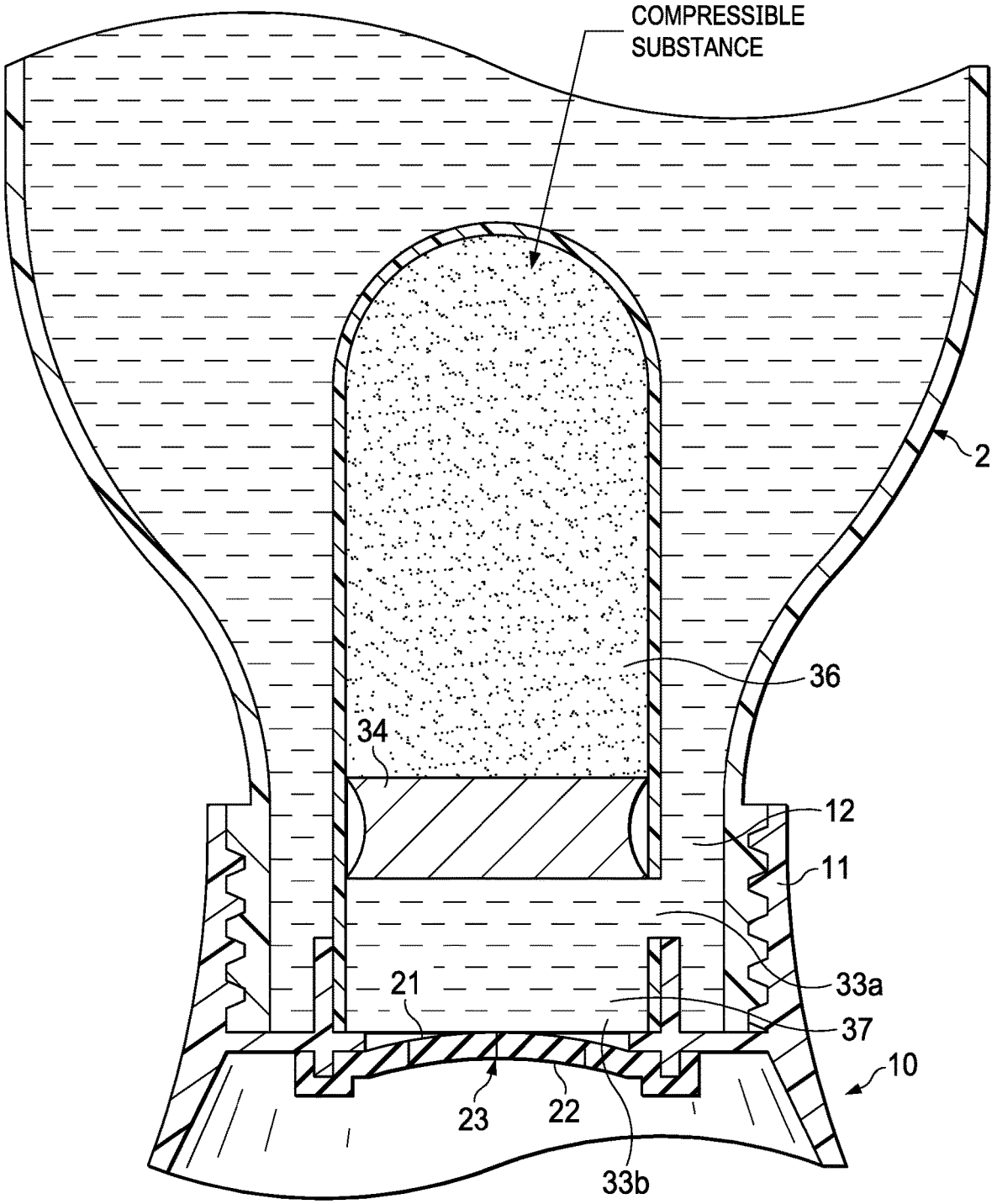
FIG. 7*c* shows a cross-sectional view of the impact resistance system (30) of the liquid dispenser (1) according to the present invention, with a moveable piston (34), prior to the "impact" and with the compressible substance uncompressed.
Figure 7D:
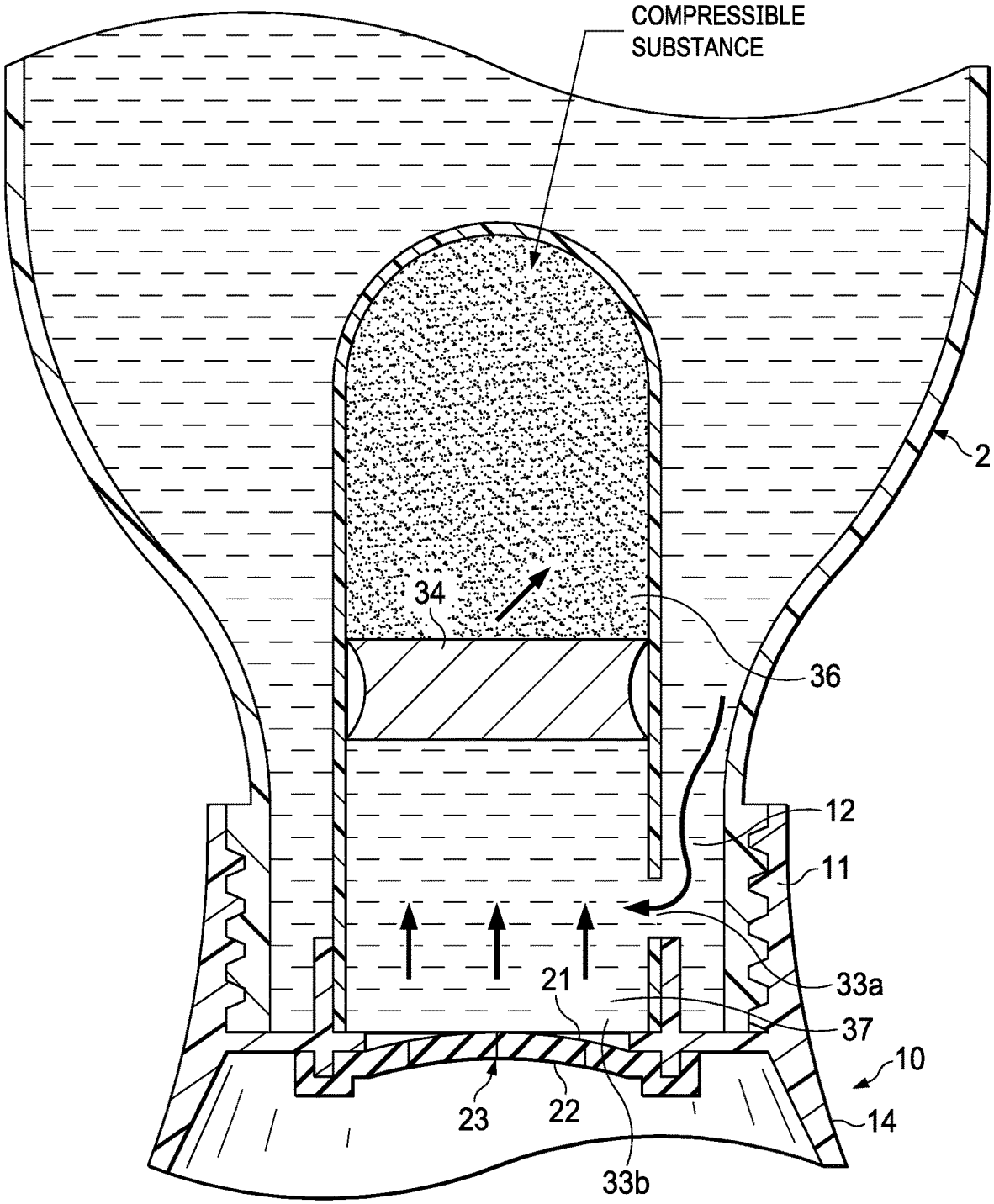
FIG. 7*d* shows a cross-sectional view of the impact resistance system (30) of the liquid dispenser (1) according to the present invention, comprising a moveable piston (34), during the "impact" and with the compressible substance compressed.

Preferably, the compressible substance is selected from a gas, a foam, a soft matter such as for example a sponge or a balloon, other viscoelastic substance (e.g., polysiloxanes), or a piston, preferably a gas, more preferably air. With reference to FIGS. 7*c* and 7*d*, the compressible substance may comprise a piston (34) moveable within the cavity (32) of the housing (31), the piston (34) coupled to a tension member attached to the distal end of the housing (31) and sealingly dividing the cavity (32) into a first (36) and second section (37). As illustrated in FIG. 7*d*, when a hydraulic hammer is subjected on the inverted container (2), liquid will flow from the inverted container (2) through the inlet opening (33*a*) into the housing (31). The liquid will press the piston (34) upwards into the cavity (32), compressing the compressible substance in between the piston (34) and the top part of the cavity accordingly, as such decreasing the downwards pressure on the valve (20). After the hydraulic pressure exposure passes, the compressible substance will decompress, moving the piston (34) back downwards and the liquid flows back from the housing (31) through the inlet opening (33*a*) into the inverted container (2).

Figure 7E:
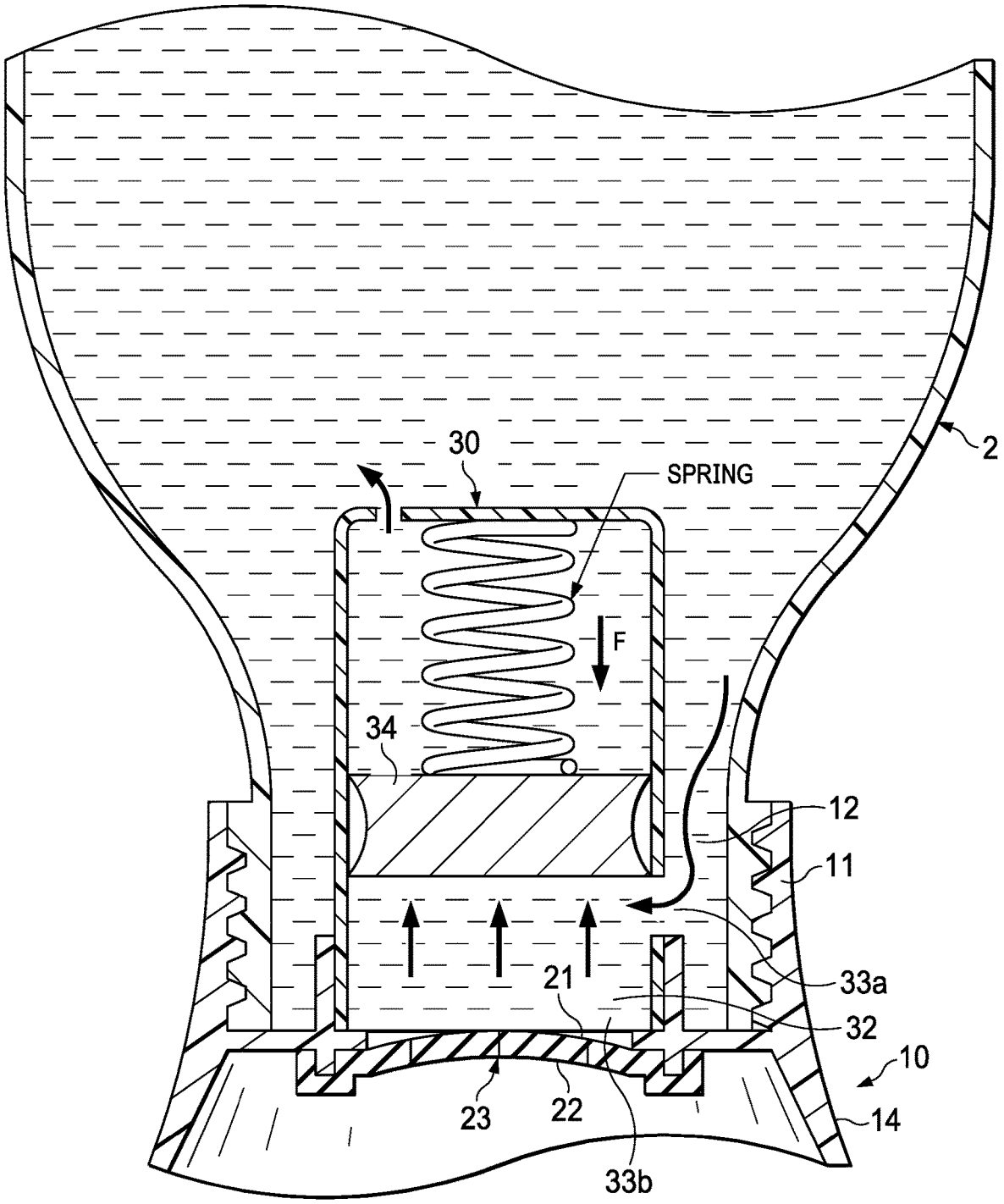
FIG. 7*e* shows a cross-sectional view of the impact resistance system (30) of the liquid dispenser (1) according to the present invention, comprising a spring-loaded moveable piston (34), prior to "impact" and with the compressible substance uncompressed.

Alternatively, the compressible substance may comprise a spring-loaded piston (34) as shown in FIG. 7*e*. Here the spring (53) functions as the compressible substance. For example, the volume above the piston (34) is filled with liquid and upon impact the transient hydraulic hammer force compresses the spring (53) connected to the piston (34) causing the liquid in the volume above the piston (34) to evacuate back into the inverted container (2) via a small opening (54) (as shown in FIG. 7*e*). The net outcome is a resultant net decrease of the downwards pressure on the valve (20) allowing it to remain closed during the impact. After the hydraulic pressure exposure passes, the spring (53) will decompress, moving the piston (34) back downwards and the liquid flows back from the inverted container (2) through the small opening (54) into the volume above the piston (34).

Figure 7F:
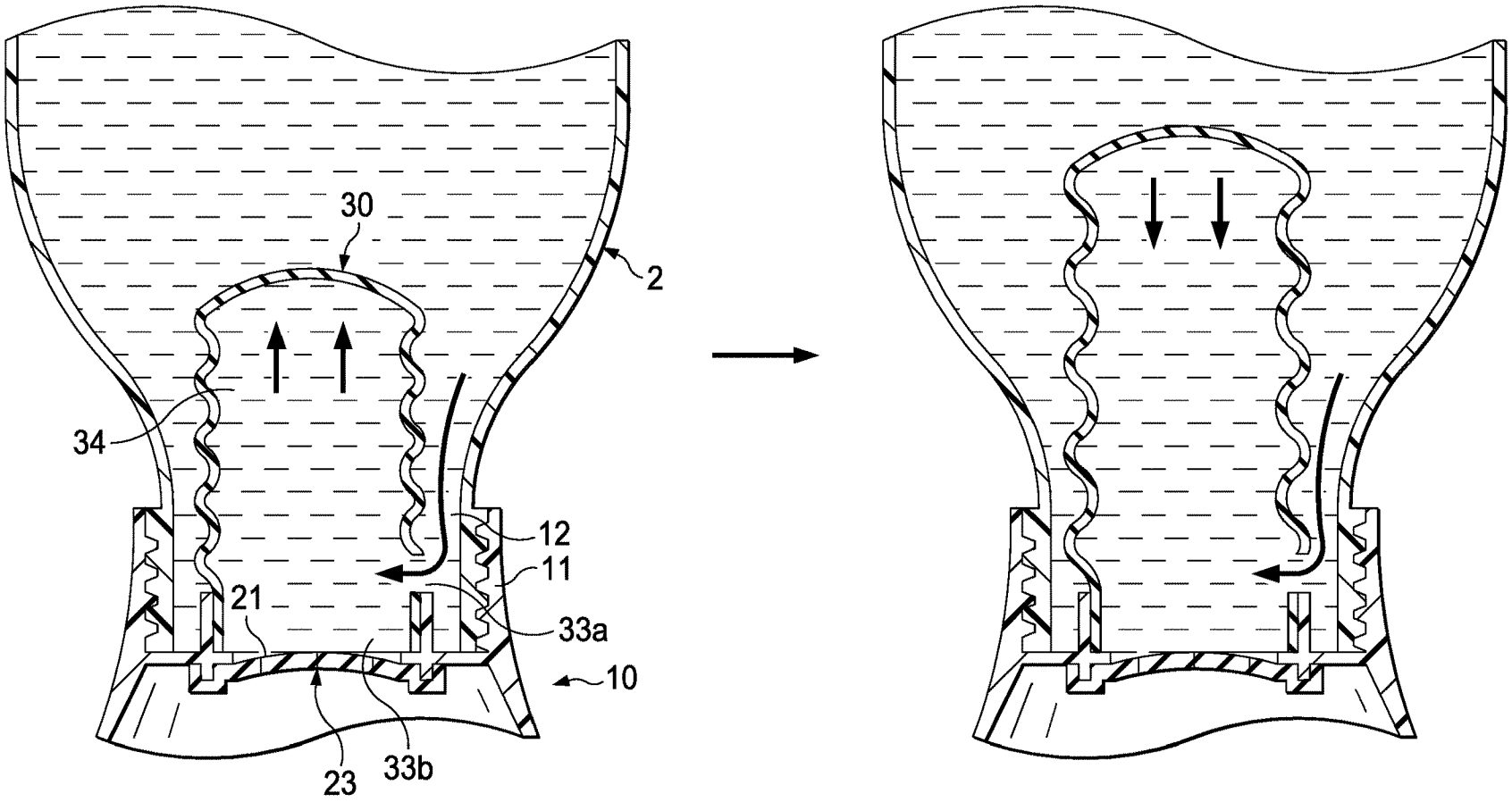
FIG. 7*f* shows a cross-sectional view of the impact resistance system (30) of the liquid dispenser (1) according to the present invention, comprising a flexible bellow dome, both prior to and during "impact".

Alternatively, the compressible substance may comprise a flexible bellow dome (55) as shown in FIG. 7*f*. Here the transient hydraulic hammer force expands the bellow dome (55) causing the cavity (32) of the impact resistance system (30) to fill up with liquid, as such decreasing the downwards pressure on the valve (20). After the hydraulic pressure exposure passes, the flexible bellow dome (55) will deflate, returning the flexible bellow dome (55) to its starting shape and the liquid flows back from the housing (31) through the inlet opening (33*a*) into the inverted container (2). It will be understood that the flexible bellow dome (55) can be made of any flexible materials know to those skilled in the art.

Figure 7G:
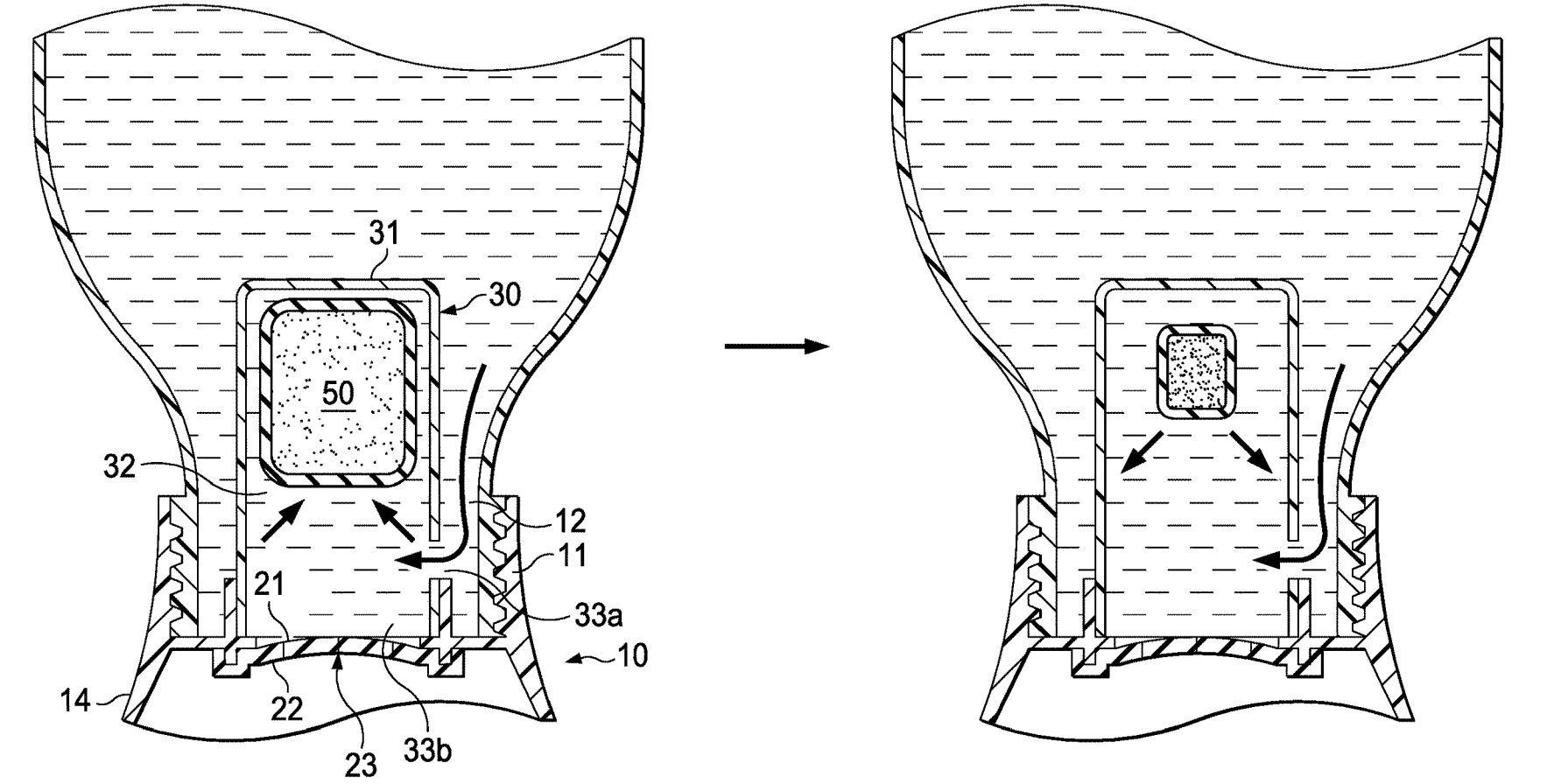
FIG. 7*g* shows a cross-sectional view of the impact resistance system (30) of the liquid dispenser (1) according to the present invention, comprising a gas filled balloon (50), both prior to and during "impact".

Alternatively, the compressible substance may comprise a gas filled balloon (50) as shown in FIG. 7*g*. Here the transient hydraulic hammer force compresses the balloon (50) allowing the cavity (32) of the impact resistance system (30) to fill up with liquid, as such decreasing the downwards pressure on the valve (20). After the hydraulic pressure exposure passes, the balloon (50) will expand again returning to its starting shape and the liquid flows back from the housing (31) through the inlet opening (33*a*) into the inverted container (2).

Figure 7H:
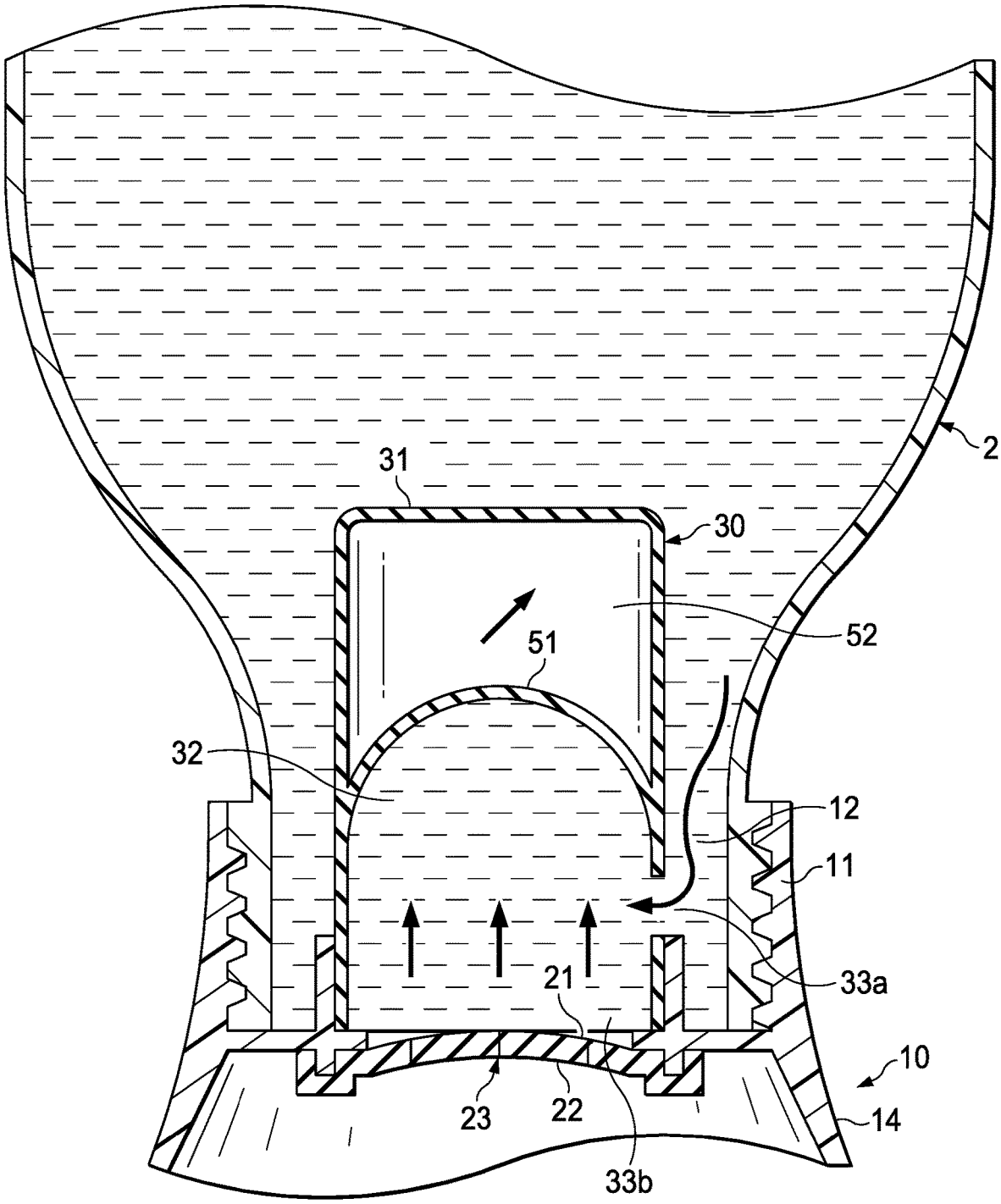
FIG. 7*h* shows a cross-sectional view of the impact resistance system (30) of the liquid dispenser (1) according to the present invention, comprising a flexible membrane (51) and a closed cavity (52), during "impact".

Alternatively, the compressible substance may comprise a flexible membrane (51) and a closed cavity (52) as shown in FIG. 7*h*. Here the transient hydraulic hammer forces the flexible membrane (51) to pop upwards and compresses the air inside the closed cavity (52) and allowing the cavity (32) of the impact resistance system (30) to fill up with liquid, as such decreasing the downwards pressure on the valve (20). After the hydraulic pressure exposure passes, the flexible membrane (51) will return to its starting position and the liquid flows back from the housing (31) through the inlet opening (33*a*) into the inverted container (2).

When the inverted container (2) is impacted, dropped or knocked over, the movement of the liquid inside the inverted container (2) causes an increased transient liquid pressure (i.e., hydraulic pressure hammer). This increased transient liquid pressure travels from the inside of the inverted container (2) through the inlet opening (33*a*) to the housing (31) and the valve interior side (21). The increased transient liquid pressure is of sufficient magnitude to exceed the combined force of the internal resistance force of the valve (20), as discussed herein above, and the opposing exterior atmospheric pressure acting on the valve exterior side (22). This causes the valve (20) to inadvertently open momentarily and leak liquid from the liquid dispenser (1) under such conditions.

The aim of the impact resistance system (30) is to divert the liquid movement (i.e., the increased transient liquid pressure) caused by the impact away from the valve interior side (21) and direct it towards the compressible substance. As shown in FIG. 7*b*, the increased transient liquid pressure compresses the compressible substance in the cavity (32) to absorb the pressure increase allowing for the pressure equilibration between the valve interior side (21) and the valve exterior side (22). As a result, the dispensing orifice (23) is allowed to remain reactively closeable under such conditions, thereby substantially reducing or preventing the tendency of the valve (20) to open during impact. The inventors have discovered that in order to maintain the reactively closeable state for the dispensing orifice (23) the preferred ratio of the volume of the gas, preferably air, inside the housing (31) at a steady state to the volume of the inverted container is higher than 0.001:1, preferably between 0.005:1 and 0.05:1, more preferably between 0.01:1 and 0.02:1. Without wishing to be bound by theory it is believed that a minimum compression threshold is desired to significantly reduce or prevent leakage risk under expected exposure conditions during transport or usage. This minimum compression threshold directly correlates with the volume of liquid that can be stored inside the inverted container (2).

For example, larger sized inverted containers (2) can hold larger liquid volumes. When these larger sized inverted containers (2) are impacted, a higher mass of liquid will move upon a hydraulic hammer and as such a higher increased transient liquid force (F=m*a—second law of Newton, with "F" being force, "m" being mass of moving liquid, and "a" being acceleration speed of moving liquid) and hence pressure will be created into the housing (31). As there is a limit towards how much transient pressure can be absorbed per unit of volume of compressible substance, when exceeding that threshold the remaining transient pressure will get translated onto the valve (20), causing leakage accordingly. As such a higher volume of compressible substance is required for higher volumes of liquid into the inverted container (2) to have enough impact resistance buffer to prevent leakage upon an eventual hydraulic hammer exposure.

Figure 8:
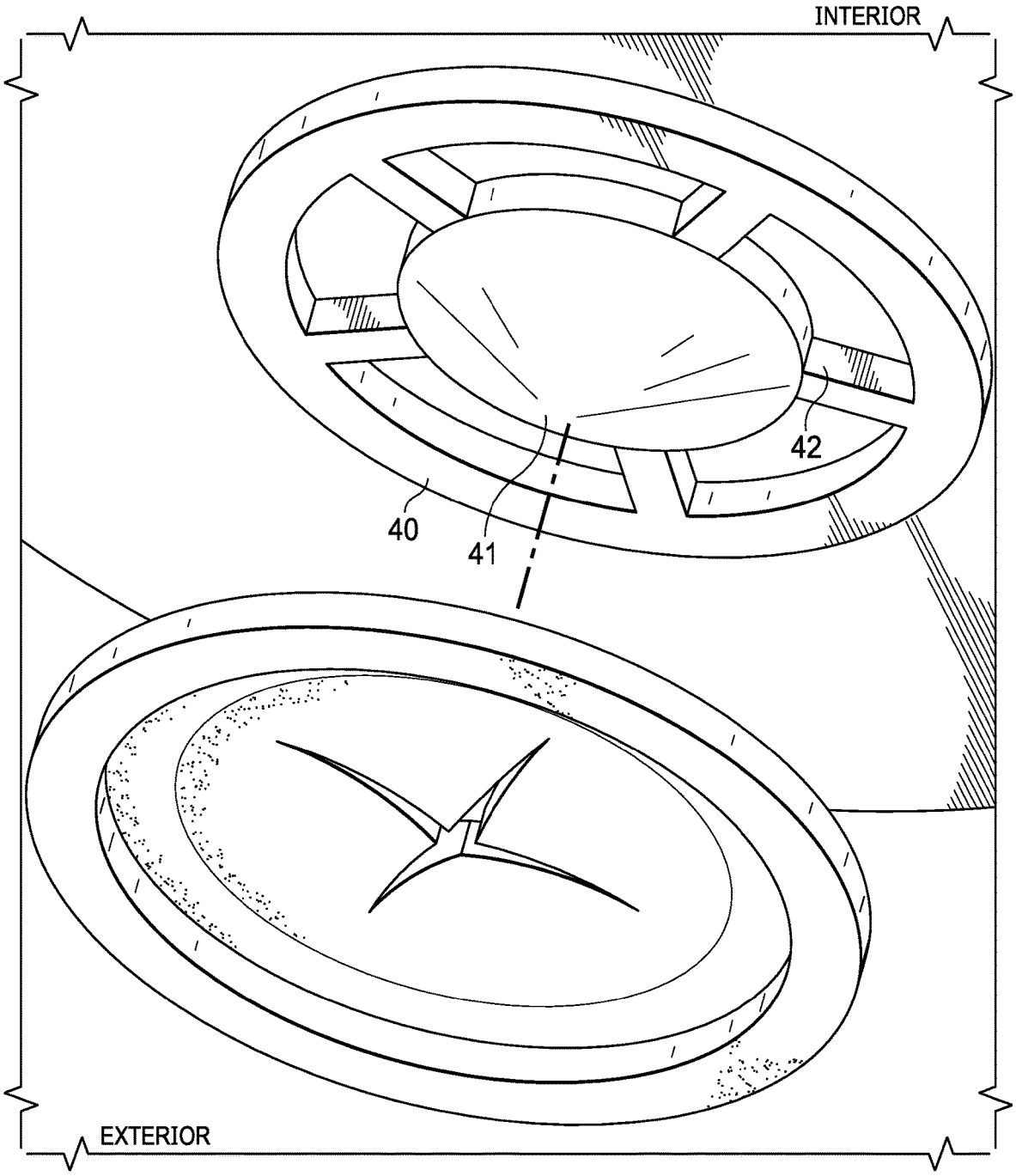
FIG. 8 shows a perspective view of the liquid dispenser (1) according to the present invention with a baffle (40).

In some applications, it is preferable to use the liquid dispenser (1) with an optional baffle (40). Preferably the baffle (40), if present, is located between the interior side (21) of the valve (20) and the impact resistance system (30). As shown in FIG. 8, the baffle (40) preferably includes an occlusion member (41) supported by at least one support member (42) which accommodates movement of the occlusion member (41) between a closed position occluding liquid flow into at least a portion of the discharged conduit (12) when the baffle (40) is subjected to an upstream hydraulic hammer pressure. Without wishing to be bound by theory, it is believed that the baffle (40) will act as an additional counter-force against the hydraulic hammer, as such further reducing a potential leakage risk. In other words, the baffle (40) functions as a wave breaker to protect the valve (20) from the turbulent kinetic energy of the hydraulic hammer. Suitable custom made baffles (40) can be obtained from the APTAR Group.

Inverted Container

It will be evident that the invention can be used with any type of containers. Preferably, the liquid dispenser (1) is used with the type of inverted container (2) as depicted in FIG. 1. Preferably the liquid dispenser (1) does not comprise a closing cap or seal that is suitable for closing the dispensing orifice (23). It is advantageous to not include the closing cap or seal so that the consumer may more easily and quickly dose the liquid from inside the inverted container (2) without bothering with the additional step of opening the cap. Additionally, the closing cap may be accidentally removed from the container (2) or consumers forget to reclose or failed to reclose properly the capon the inverted containers (2) and therefore may fail to prevent liquid leakage.

The inverted container (2) preferably is a squeezable inverted container (2), having at least one, preferably at least two, resiliently deformable sidewall or sidewalls (3). Preferably the inverted container (2) is characterized as having from 5 N to 30 N @15 mm sidewalls deflection, preferably 10 N to 25 N @ 15 mm sidewalls deflection, more preferably 18 N, @ 15 mm sidewalls (3) deflection. The inverted container (2) may be grasped by the consumer, and the resiliently deformable sidewall or sidewalls (3) may be squeezed or compressed causing pressure to be applied (also referred to as "applied force") to compress the compressible substance in the cavity (32). As a result, the increase of the internal pressure causes the liquid between the inverted container (2) and the valve (20) to be dispensed to the exterior atmosphere through the dispensing orifice (23). When the squeezing or compressing force is removed, the resiliently deformable sidewall or sidewalls (3) are released to vent air from the exterior atmosphere to the cavity (32) to decompress the compressible substance in the cavity (32) and return the resiliently deformable sidewall or sidewalls (3) to its original shape. Additionally, the venting also refills the cavity (32) of the housing (31) with air from the exterior atmosphere. The vented air moves back into the inverted container (2) via the inlet opening (33*a*) to compensate for the volume of dispensed liquid.

TEST METHODS

The following assays set forth must be used in order that the invention described and claimed herein may be more fully understood.

Test Method 1: Leakage Resistance Test

Figure 10:
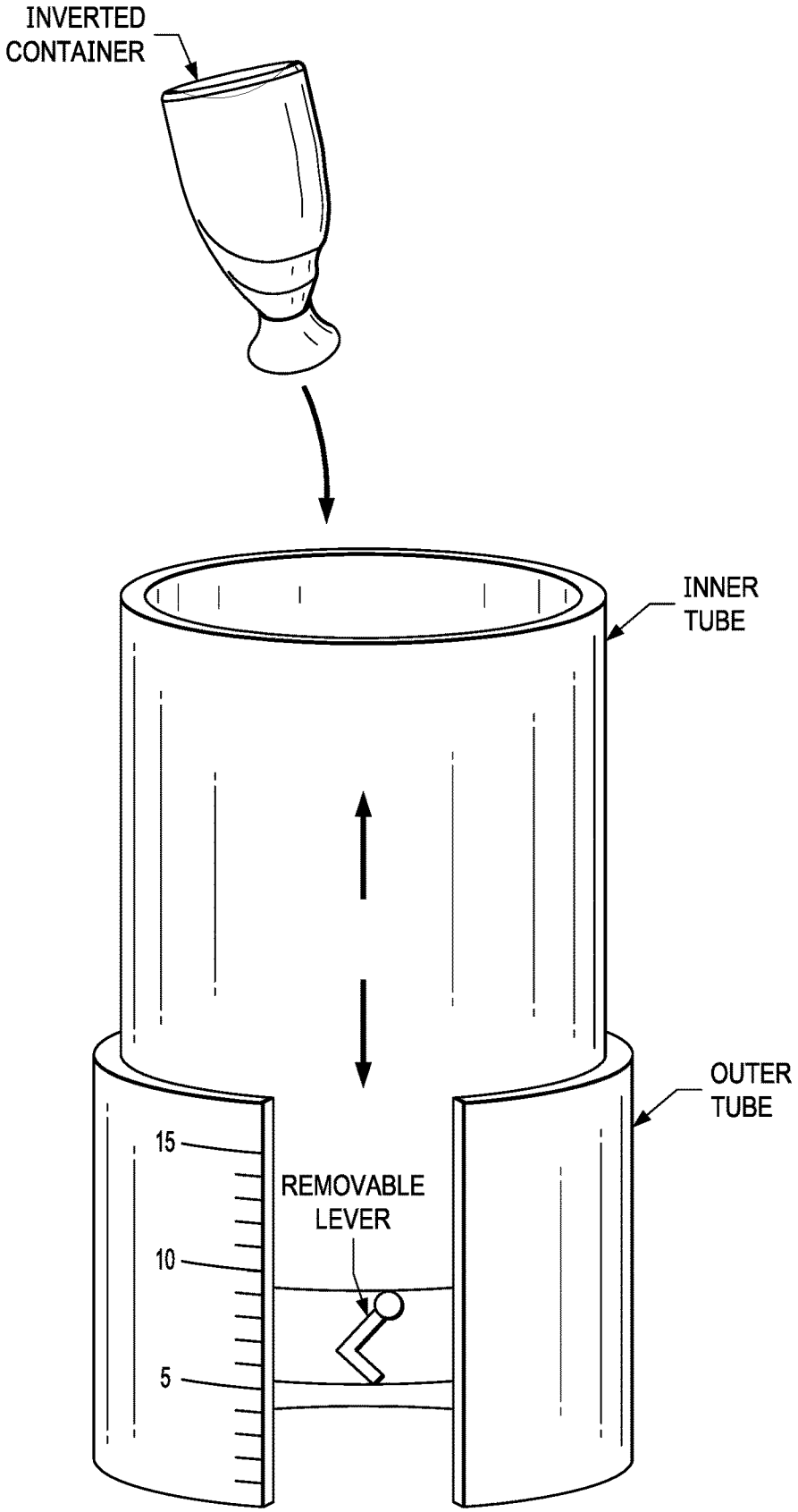
FIG. 10 shows a drop tester apparatus and the procedures in the Leakage Resistance Test.

The purpose of the Leakage Resistance Test is to assess the ability of a liquid dispenser to prevent leakage of the liquid from an inverted container during "impact". The impact occurs when the inverted container is dropped, liquid dispenser side down, from a certain height onto a flat surface. The drop is supposed to mimic the resulting transient liquid pressure increases upon impact inside the inverted container. The leakage resistance ability of the liquid dispenser is evaluated through measurement of the drop height till which no volume/weight of the liquid leaks out when dropped. A higher leak-free drop height correlates to better leakage resistance ability for the liquid dispenser. The steps for the method are as follows:

1. Use a drop tester apparatus as shown in FIG. 10. The apparatus consists of two top and bottom open ended cylindrical tubes with an approximate diameter of 12 cm, i.e. an outer tube tightly surrounding an inner tube movable in vertical direction into the outer tube, the outer tube having a cut out section to enable visual assessment of the relative height of the inner tube within the outer tube through a grading scale applied on the outer tube. A removable lever is applied at the bottom of the inner tube, allowing an inverted container (2) positioned with its opening downwards within the inner tube to rest on the lever. When the lever is manually removed the inverted container drops down and the amount of leaked liquid after the exposure is weighed. Therefore, a piece of paper is positioned on a hard surface at the bottom of the open ended outer container to capture the leaked liquid. The weight of the paper is measured on a balance prior and after the drop test to define the amount of leaked liquid. The height at which the lever was positioned prior to manual removal is measured as the drop height.
2. Fill an inverted container (2) having a defined volume (e.g., 400 mL or 650 mL) with a standard liquid dishwashing detergent having a density of 1.03 g/mL and a Newtonian viscosity of 1000 cps at 20° C. when measured on a Brookfield type DV-II with a spindle 31 at rotation speed 12 RPM to a defined fill level within the inverted container. For example, with a 400 mL inverted container fill with 400 mL of liquid dishwashing detergent, and with a 650 mL inverted container fill with 650 mL of liquid dishwashing detergent. The liquid fill level, inverted container volume and liquid composition is kept constant when cross-comparing different closing systems.
3. Assemble a liquid dispenser comprising a valve (Simplicity 21-200 "Simplisqueeze®" valve available from Aptar Group, Inc.) with the inverted container (2), as shown in FIG. 4. The liquid dispenser has a frustoconical shaped exterior portion (e.g., bottom diameter 65 mm, top diameter 34 mm and height 30 mm) for resting on the flat surface, and optionally fitted with an internally developed baffle (e.g., diameter 7 mm, 5 ribs emerging from center ball of 4 mm to the outside), an impact resistance system (30) according to the present invention or both.
4. Set up the drop height (from 2 cm to 15 cm) on the drop tester.
5. Cut a piece of paper approximately 7 cm×7 cm for fitting the opening at the lower end of the outer tube.
6. Weigh the piece of paper using a Mettler Toledo PR1203 balance and record its weight.
7. Place the piece of paper under the opening at the lower end of the outer tube.

8. Place the assembled liquid dispenser and inverted container (2), liquid dispenser side down, into the inner tube of the drop tester.
9. Pull back the lever in the drop tester in a quick and smooth motion.
10. Remove the tubes and the assembled liquid dispenser and inverted container from the drop tester.
11. Weigh the piece of paper a second time and record the weight. Calculate the weight difference of the paper, and the delta corresponds to the amount of liquid leaked from the liquid dispenser.
12. Repeat steps 5 to 11 four more times for a total of five replicates for each test condition.
13. Calculate the average maximum drop height at which no liquid leaked.

EXAMPLE

The following examples are provided to further illustrate the present invention and are not to be construed as limitations of the present invention, as many variations of the present invention are possible without departing from its spirit or scope.

Example 1: Leakage Resistance Data

The ability of the liquid dispenser comprising an impact resistance system according to the present invention (Examples 1 and 2) to substantially reduce or prevent liquid leakage has been assessed and cross-compared to prior disclosed silicone valve (Comparative Example 1) and combined silicone valve—baffle (Comparative Example 2) systems.

Table 1 summarizes the maximum drop heights of different closing executions by conducting the leakage resistance test described above. From the results it can be seen that a liquid dispenser (1) comprising an impact resistance system (30) according to the invention, comprising a silicon valve (20) and a housing (31) comprising a 10 mL air bubble (Example 1), has a higher robustness against a hydraulic hammer impact action compared to a silicon valve alone (Comparative Example 1) or the previously disclosed silicone valve—baffle combination (Comparative Example 2). Combination of an impact resistance system (30) according to the invention with a baffle system (40) (Example 2) allows to further reduce the volume of compressible substance (e.g., air) required to prevent leakage upon a hydraulic hammer like impact.

TABLE 1

Leakage Resistance Results

| Example | Execution | Drop Height Till Leakage 400 mL | Drop Height Till Leakage 650 mL |
|---|---|---|---|
| Comparative Example 1 | Silicon valve | 0-1 cm | 0-1 cm |
| Comparative Example 2 | Baffle + Silicon valve | 4 cm | 2 cm |
| Example 1 | Air bubble 10 mL + Silicon valve | 6 cm | 4 cm |
| Example 2 | Air bubble 2 mL + Baffle + Silicon valve | 10 cm | 6 cm |

All percentages and ratios herein are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid dispenser for releasably affixing to an inverted container containing dispensable liquid, the dispenser comprising:

i) a body of the dispenser comprising a connecting sleeve, wherein the connecting sleeve is adaptable for engaging to an exterior surface proximate an opening of the inverted container and is spaced radially inwardly to define an internal discharge conduit for establishing fluid communication with the liquid contained in the inverted container;

ii) a valve localized in the body extending across the internal discharge conduit, the valve having an interior side for being contacted by the liquid contained inside the inverted container and an exterior side for being exposed to the exterior atmosphere, wherein the valve defines a dispensing orifice that is reactively openable when pressure on the valve interior side exceeds pressure on the valve exterior side; and iii) an impact resistance system localized upstream of the valve, the system comprises a housing having a cavity therein and extending longitudinally from the body and radially inwardly from the sleeve, wherein the housing comprises at least one inlet opening that provides a flow path for the liquid from the inverted container into the housing and at least one outlet opening that provides a path of egress for the liquid from the housing to the exterior atmosphere when the dispensing orifice is opened, wherein the cavity is adapted to be partially occupied by a compressible substance.

2. The liquid dispenser according to claim 1, wherein the compressible substance is selected from a gas, a foam, a sponge or a balloon.

3. The liquid dispenser according to claim 2, wherein the compressible substance is gas.

4. The liquid dispenser according to claim 3, wherein the ratio of volume of the gas inside the housing at a steady-state to volume of the inverted container is higher than about 0.001:1.

5. The liquid dispenser according to claim 4, wherein the ratio of the volume of the gas inside the housing at a steady-state to the volume of the inverted container is between 0.01:1 and 0.02:1.

6. The liquid dispenser according to claim 1 wherein the housing has an internal volume of from about 200 $mm^3$ to about 250,000 $mm^3$.

7. The liquid dispenser according to claim 6 wherein the housing has an internal volume of from about 1,500 $mm^3$ to about 75,000 $mm^3$.

8. The liquid dispenser according to claim 1, wherein the inlet opening has a total surface area of about 1 $mm^2$ to about 250 $mm^2$.

9. The liquid dispenser according to claim 8, wherein the inlet opening has a total surface area of about 15 $mm^2$ to about 150 $mm^2$.

10. The liquid dispenser according to claim 1, wherein the housing comprises a plastic material.

11. The liquid dispenser according to claim 10, wherein the plastic material is a thermoplastic material.

12. The liquid dispenser according to claim 1, wherein a force exerted on the valve interior side is at least about 10 mbar to open the dispensing orifice.

13. The liquid dispenser according to claim 1, wherein an internal resistance force of the valve is at least about 10 mbar.

14. The liquid dispenser according to claim 1, wherein the valve comprises of a flexible central portion having at least two slits which extend radially outward to distal ends, the slits intersect to define the dispensing orifice.

15. The liquid dispenser according to claim 1, wherein the body comprises at a bottom end (B) an exterior portion adapted for resting the inverted container on a flat surface in an upside-down or inverted position.

16. The liquid dispenser according to claim 1, further comprising a baffle located in between the interior side of the valve and the impact resistance system.

17. The liquid dispenser according to claim 13, wherein the baffle includes an occlusion member supported by at least one support member which accommodates movement of the occlusion member between a closed position occluding liquid flow into at least a portion of the internal discharge conduit when the baffle is subjected to an upstream hydraulic hammer pressure.

18. The liquid dispenser according to claim 1, wherein the dispensing orifice is designed to be in the open position when a pressure difference of at least about 10 mbar exists between the valve interior side in relation to the valve exterior side.

19. An inverted container comprising a liquid dispenser according to claim 1, wherein the liquid dispenser does not comprise a closing cap or seal.

20. The inverted container of claim 16, wherein the inverted container has at least one resiliently deformable sidewall, when the resiliently deformable sidewall on the inverted container is elastically deformed by squeezing and causing pressure to be applied to compress the compressible substance in the cavity and causing the liquid between the container and the resilient valve to be dispensed to the exterior atmosphere through the dispensing orifice, and when the resiliently deformable sidewall is released to vent air from the exterior atmosphere to the cavity to decompress the compressible substance in the cavity returning the resiliently deformable sidewall to the sidewall's original shape.

* * * * *